US009414657B1

(12) United States Patent
Cheng

(10) Patent No.: US 9,414,657 B1
(45) Date of Patent: Aug. 16, 2016

(54) MAGNETIC RING

(71) Applicant: Yu-Feng Cheng, New Taipei (TW)

(72) Inventor: Yu-Feng Cheng, New Taipei (TW)

( * ) Notice: Subject to any disclaimer, the term of this patent is extended or adjusted under 35 U.S.C. 154(b) by 0 days.

(21) Appl. No.: 14/634,974

(22) Filed: Mar. 2, 2015

(51) Int. Cl.
*A45B 25/12* (2006.01)

(52) U.S. Cl.
CPC ..... *A45B 25/12* (2013.01)

(58) Field of Classification Search
CPC ..... A45B 25/12
USPC ..... 428/66.6; 135/16, 37
See application file for complete search history.

(56) References Cited

U.S. PATENT DOCUMENTS 3,510,079 A * 5/1970 Flowers ..... D01H 7/16
242/597.6

* cited by examiner

*Primary Examiner* — Alexander Thomas
(74) *Attorney, Agent, or Firm* — Alan D. Kamrath; Kamrath IP Lawfirm, P.A.

(57) ABSTRACT

Provided is a magnetic ring for an umbrella, the magnetic ring including: a top, a bottom, an inner side part, and an outer side part. The magnetic ring is a hollow ring. The bottom further has an annular groove and at least one magnetic component mounted in the annular groove. The magnetic ring further has a first chamfer between the top and the inner side part and a second chamfer between the bottom and the inner side part. After use of the umbrella, the magnetic ring can be encircled around and slid along the folded canopy without scratching or damaging the canopy. In addition, the magnetic ring can be attracted temporarily on the umbrella stem by the magnetic component when the umbrella is unfolded. Enhanced convenience is provided for umbrella users and the magnetic ring can be used with durable fastening function.

13 Claims, 8 Drawing Sheets

MAGNETIC RING

BACKGROUND OF THE INVENTION

1. Field of the Invention

The present invention relates to a magnetic ring, and more particularly to a magnetic ring for folding and fastening the canopy of an umbrella.

2. Description of the Related Art

A conventional fastening assembly for an umbrella takes the form of a strap sewn onto the canopy, and two ends of the strap respectively have a hook fastener or a loop fastener. The strap can restrain the canopy by encircling around the canopy and pressing the hook fastener and the loop fastener together when the umbrella is collapsed.

However, the hook fastener and the loop fastener gradually lose their fastening capacity after repeated pressing and pulling apart. The fasteners can no longer be restrictive to the canopy. In this situation, users can hardly put the umbrella into an umbrella cover. The rainwater always drips and flows all over the floor and hence poses a high risk of slippage for passersby.

Another fastening assembly of an umbrella is also a strap that is sewn onto the canopy, but two ends of the strap respectively have a male snap fastener or a female snap fastener. The strap can restrain the canopy by encircling around the canopy and fastening the male snap fastener and the female snap fastener together when the umbrella is collapsed. If the snap fasteners are made of plastics, the snap fasteners are prone to damage by exposure to sunlight or by multiple times of fastening. If the snap fasteners are made of metal, the structural strength is stronger than plastic ones. However, the metal snap fasteners become rusty in the wet environment. After use for a long time, the rust stains the canopy, which is unpleasant both in appearance and hygiene.

In addition, the rainwater flows around the canopy on rainy days. Users feel cold when they operate the above-mentioned straps and contact the rainwater by hand. This cold feel is even more unbearable in the winter.

SUMMARY OF THE INVENTION

An objective of the present invention is to provide a magnetic ring as a fastening assembly for an umbrella; the magnetic ring can be used with long durability. In addition, users can operate the magnetic ring without contacting the rainwater. With the above advantages, users can easily use the present invention with ease and comfort.

To achieve the foregoing objective, the magnetic ring of an umbrella comprises a top, a bottom, an inner side part, and an outer side part.

The magnetic ring is a hollow ring. The top is opposite to the bottom, and an annular groove is formed in the bottom and forms at least a magnetic component in the annular groove of the bottom. Furthermore, the inner side part connects along inner edges of the top and the bottom. A first chamfer is formed between the top and the inner side part; a second chamfer is formed between the bottom and the inner side part.

The advantage of the present invention is that the magnetic ring can be encircled on the canopy after use of the umbrella. With the first and second chamfers, the magnetic ring cannot scratch or damage the surface of the canopy during the encircling and sliding. In addition, the magnetic ring can be attracted temporarily to the umbrella stem by magnetic components mounted in the annular groove of the bottom when the umbrella is unfolded. The present invention provides enhanced convenience for umbrella users and avoids losing the magnetic ring.

Particularly, the inner side part is a smooth surface. The curvature of the first chamfer is larger than the curvature of the second chamfer. The present invention enhances the smoothness for sliding the magnetic ring on the canopy surface. The present invention cannot scratch or damage the surface of the canopy in the encircling-and-sliding process due to the smooth surface of the inner side part and the chamfers.

Particularly, two magnetic components are mounted in the annular groove of the bottom. The two magnetic components are embedded at two opposite positions in the annular groove. Furthermore, multiple ribs are formed in the annular groove between the two magnetic components. The advantage of the present invention is that the magnetic ring can be attracted to the umbrella stem by the magnetic components when the umbrella is unfolded. Furthermore, the ribs can strengthen the structure of the magnetic ring, thereby avoiding breakage when the magnetic ring falls to the ground.

More particularly, the height of the inner side part is less than the height of the outer side part. Two notches are formed oppositely near the outer edge of the bottom and on the outer side part. The notches are corresponding in position to the magnetic components, and the height of each notch is equal to the height difference between the inner side part and the outer side part. The advantage of the present invention is that the umbrella stem can abut against the notches when the magnetic ring is attracted to the umbrella stem by the magnetic components. This design enhances the stability for mounting the magnetic ring on the umbrella stem.

DETAILED DESCRIPTION OF THE INVENTION

Figure 1:
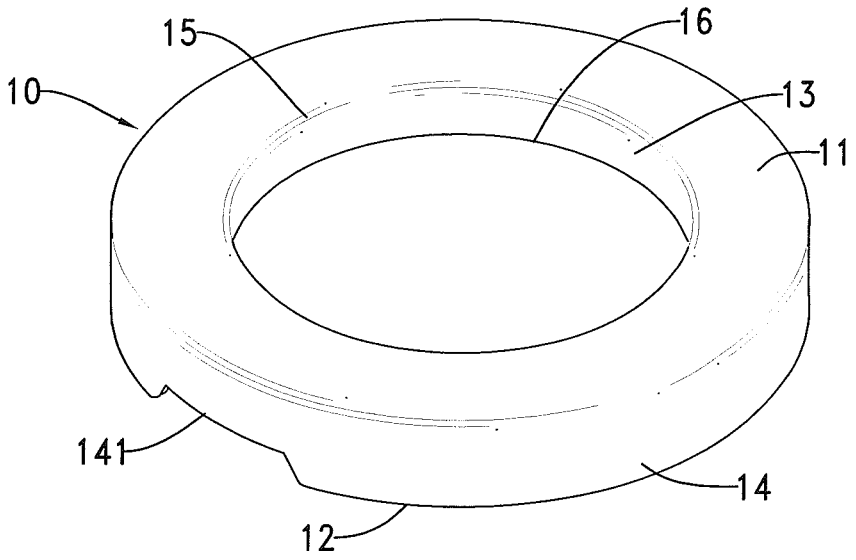
FIG. 1 is a perspective view of the magnetic ring in accordance with the present invention.
Figure 2:
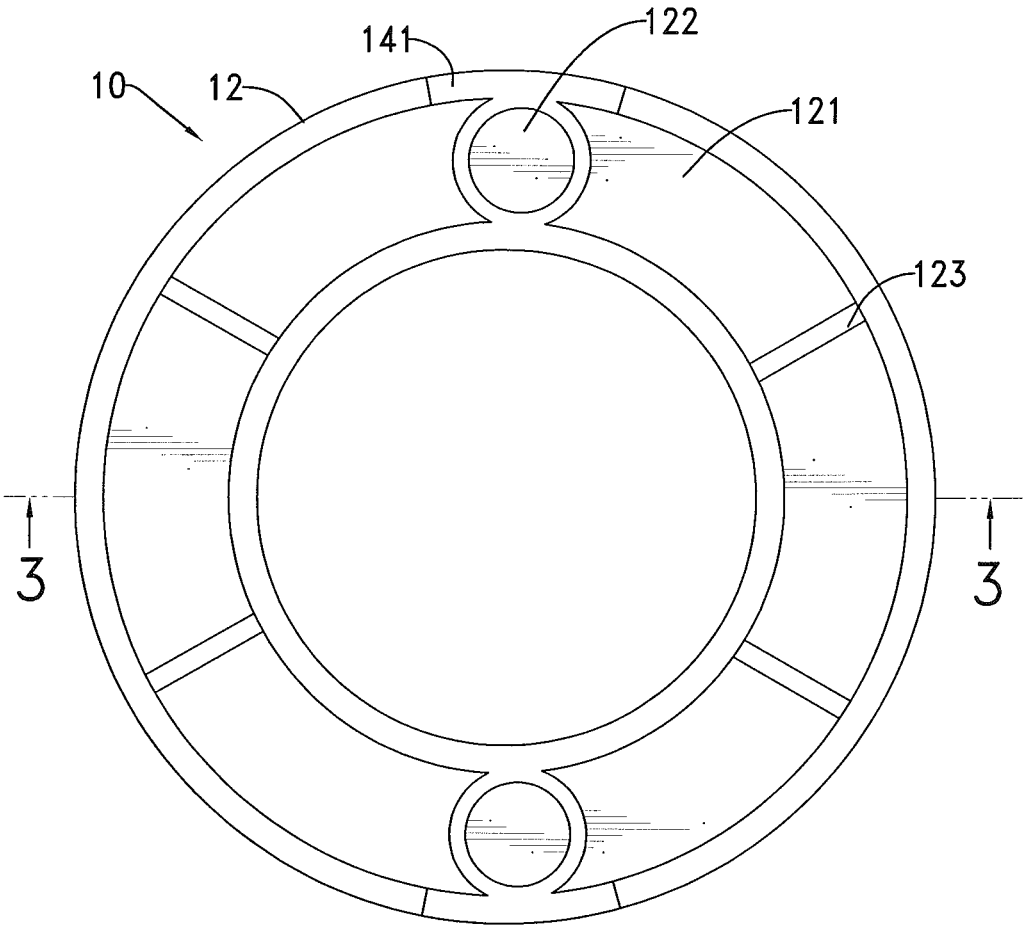
FIG. 2 is a bottom view of the magnetic ring in accordance with the present invention.
Figure 3:
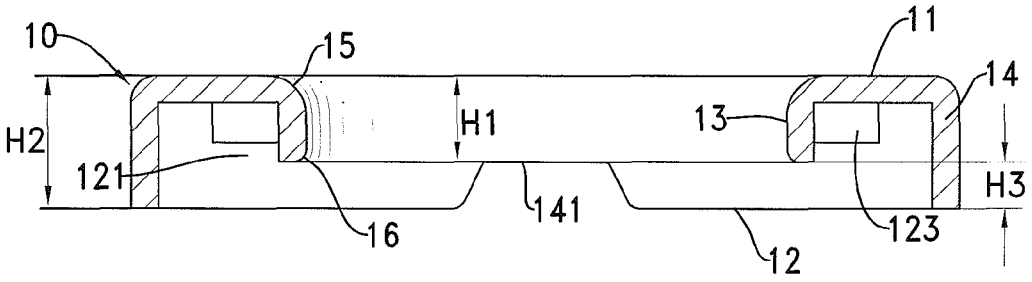
FIG. 3 is a cross-sectional side view of the magnetic ring in FIG. 2.

With reference to FIGS. 1 to 3, a magnetic ring 10 for an umbrella comprises a top 11, a bottom 12, an inner side part 13, and an outer side part 14.

The magnetic ring 10 is a hollow ring, and the top 11 is opposite to the bottom 12. The bottom 12 further comprises an annular groove 121. The annular groove 121 is formed in the bottom 12 toward the top 11. In the annular groove 121, two magnetic components 122 are mounted on the bottom 12. The two magnetic components 122 are embedded at two opposite positions in the annular groove 121. Users can unfold the umbrella and attach the magnetic ring 10 on the metal umbrella stem by magnetic attraction force between the magnetic ring 10 and the umbrella stem, thereby avoiding losing the magnetic ring 10. More specifically, the two magnetic components 122 are mounted oppositely with respect to the center of the hollow ring. The two magnetic components 122 can be attracted to the umbrella stem firmly.

Multiple ribs 123 are formed between the two magnetic components 122 in the annular groove 121. The ribs 123 can strengthen the structure of the magnetic ring 10.

The inner side part 13 is a smooth surface. After using the umbrella, users can slide the magnetic ring 10 from the end cap of the umbrella toward the handle along the surface of the canopy and the umbrella stem without scratching or damaging the surface of the canopy. The inner side part 13 is connected along inner edges of the top 11 and the bottom 12, and a first chamfer 15 is formed between the top 11 and the inner side part 13. Furthermore, a second chamfer 16 is formed between the bottom 12 and the inner side part 13. The first chamfer 15 and the second chamfer 16 also can avoid scratch or damage by the sliding of the magnetic ring 10 on the canopy surface. In addition, the curvature of the first chamfer 15 is larger than the curvature of the second chamfer 16. This design also enhances the smoothness for sliding the magnetic ring 10 on the canopy surface.

Furthermore, the outer side part 14 is connected along outer edges of the top 11 and the bottom 12. The height of the inner side part H1 is less than the height of the outer side part H2. Two notches 141 are formed oppositely from the bottom 12 toward the top 11, near the outer edge of the bottom 12, and on the outer side part 14, and the notches 141 are corresponding in position to the magnetic components 122. The height of each notch H3 is equal to the height difference between the inner side part 13 and the outer side part 14 (H2−H1). The surface distal from the top 11 of each magnetic component 122 and the second chamfer 16 are in the same horizontal level. When the magnetic ring 10 is mounted on the umbrella stem by the magnetic components 122, the umbrella stem can abut against the notches 141. This design enhances the stability for mounting the magnetic ring 10 on the umbrella stem.

Figure 4:
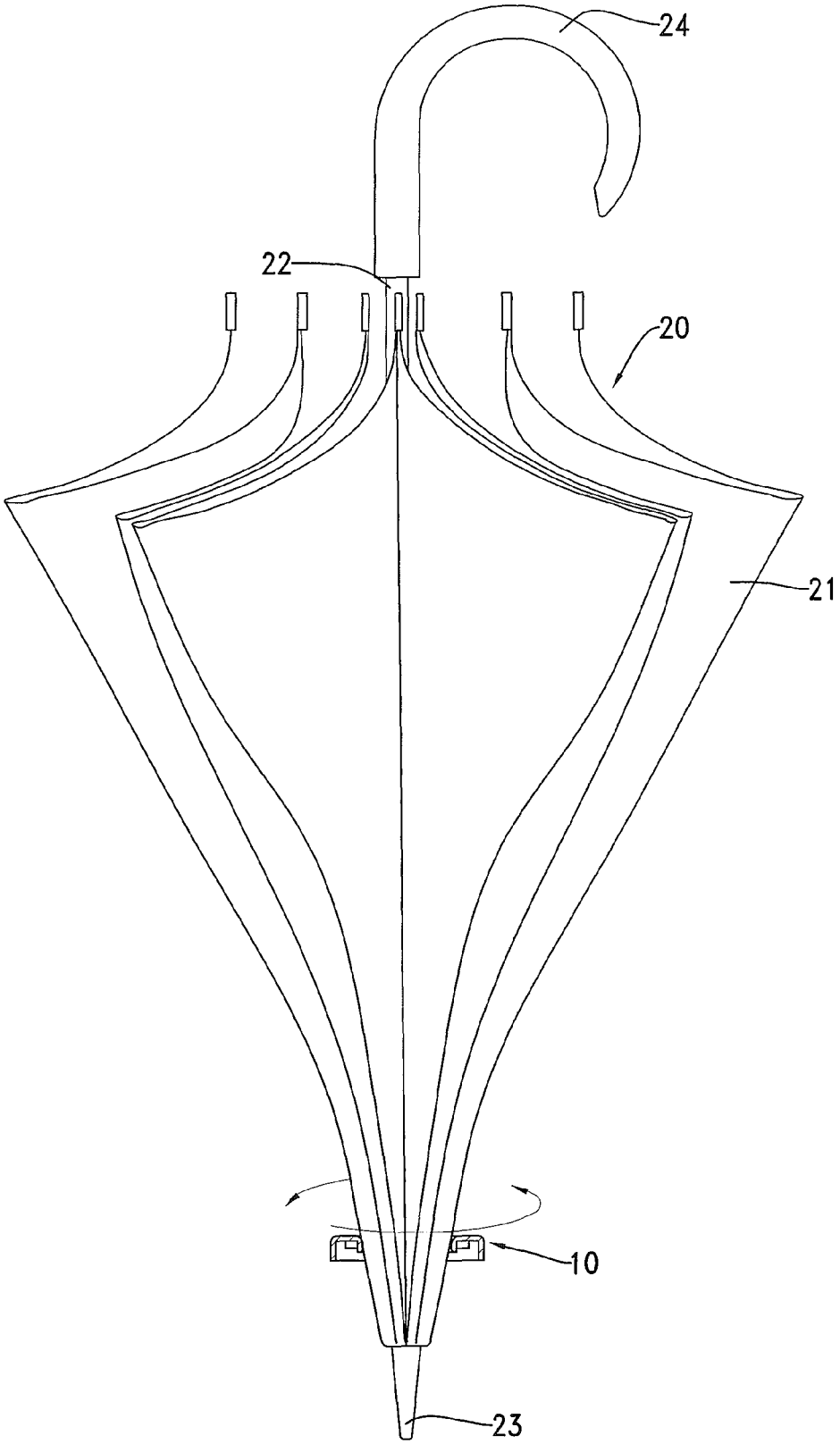
FIG. 4 is a schematic view of the magnetic ring in accordance with the present invention, shown in use.
Figure 5:
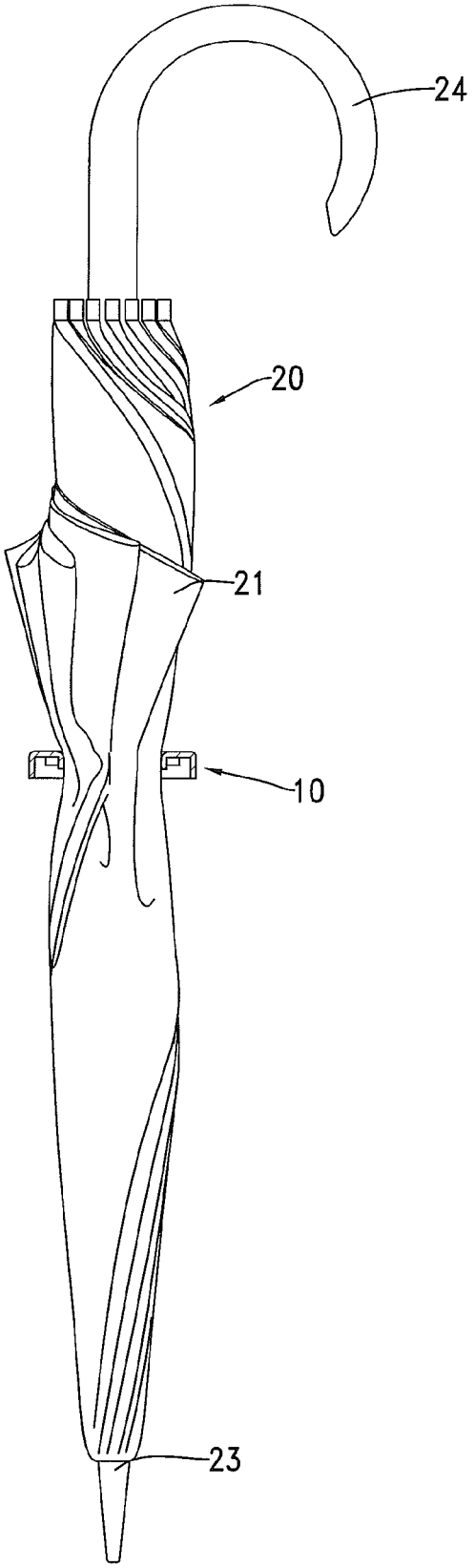
FIG. 5 is another schematic view of the magnetic ring in accordance with the present invention, shown in use.

With reference to FIGS. 4 and 5, the canopy 21 is fluffy after use of the umbrella 20. Users can rotate the magnetic ring 10 and gradually move the magnetic ring 10 from the end cap of the umbrella 23 toward the handle 24 along the surface of the canopy 21 and the umbrella stem 22. Then the canopy 21 is folded in the same direction, and the rainwater on the canopy 21 is encapsulated in the folded canopy 21. The magnetic ring 10 not only tightly encircles the canopy 21 but also prevents the rainwater from dripping everywhere.

Figure 6:
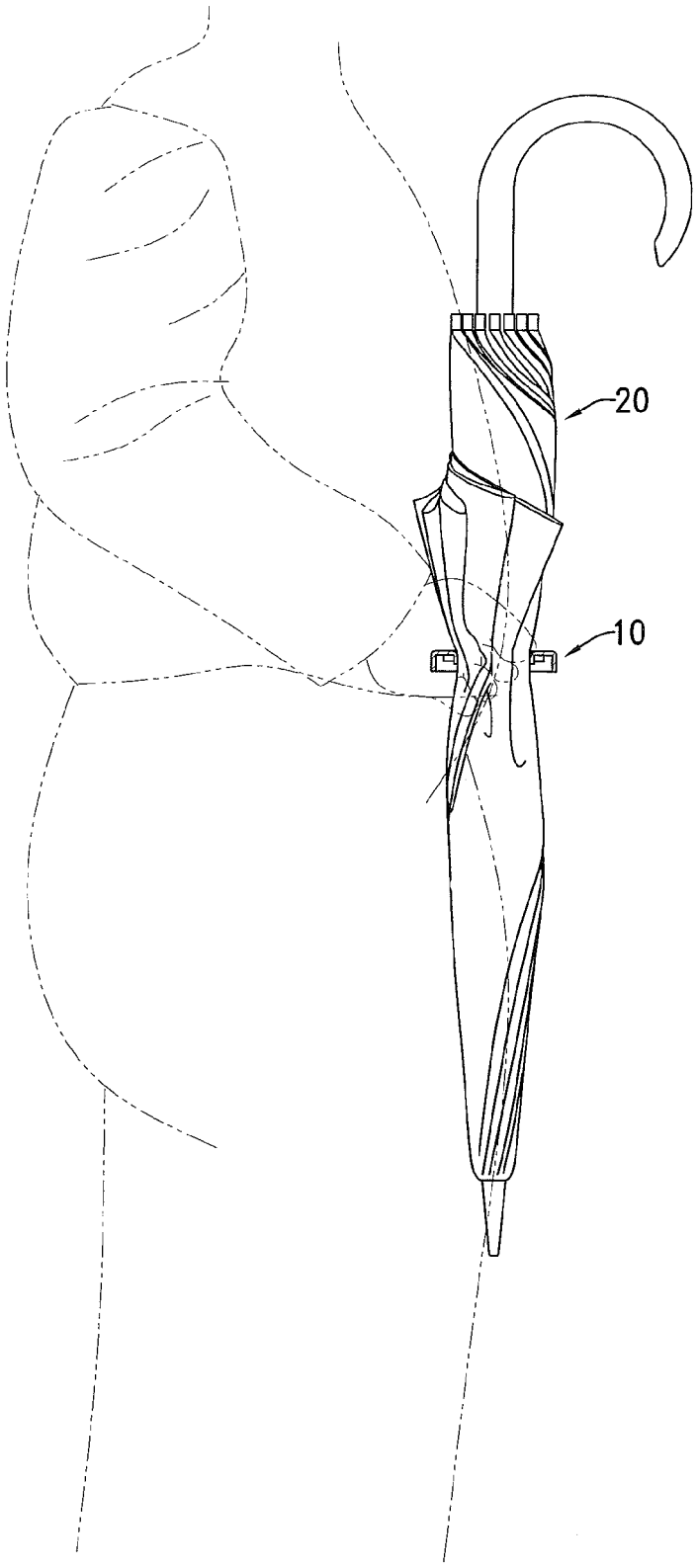
FIG. 6 is a schematic view of the magnetic ring in accordance with the present invention, shown held by a user's hand.

With reference to FIG. 6, when the canopy is encircled by the magnetic ring, users also can grasp the umbrella 20 by holding the magnetic ring 10.

Figure 7:
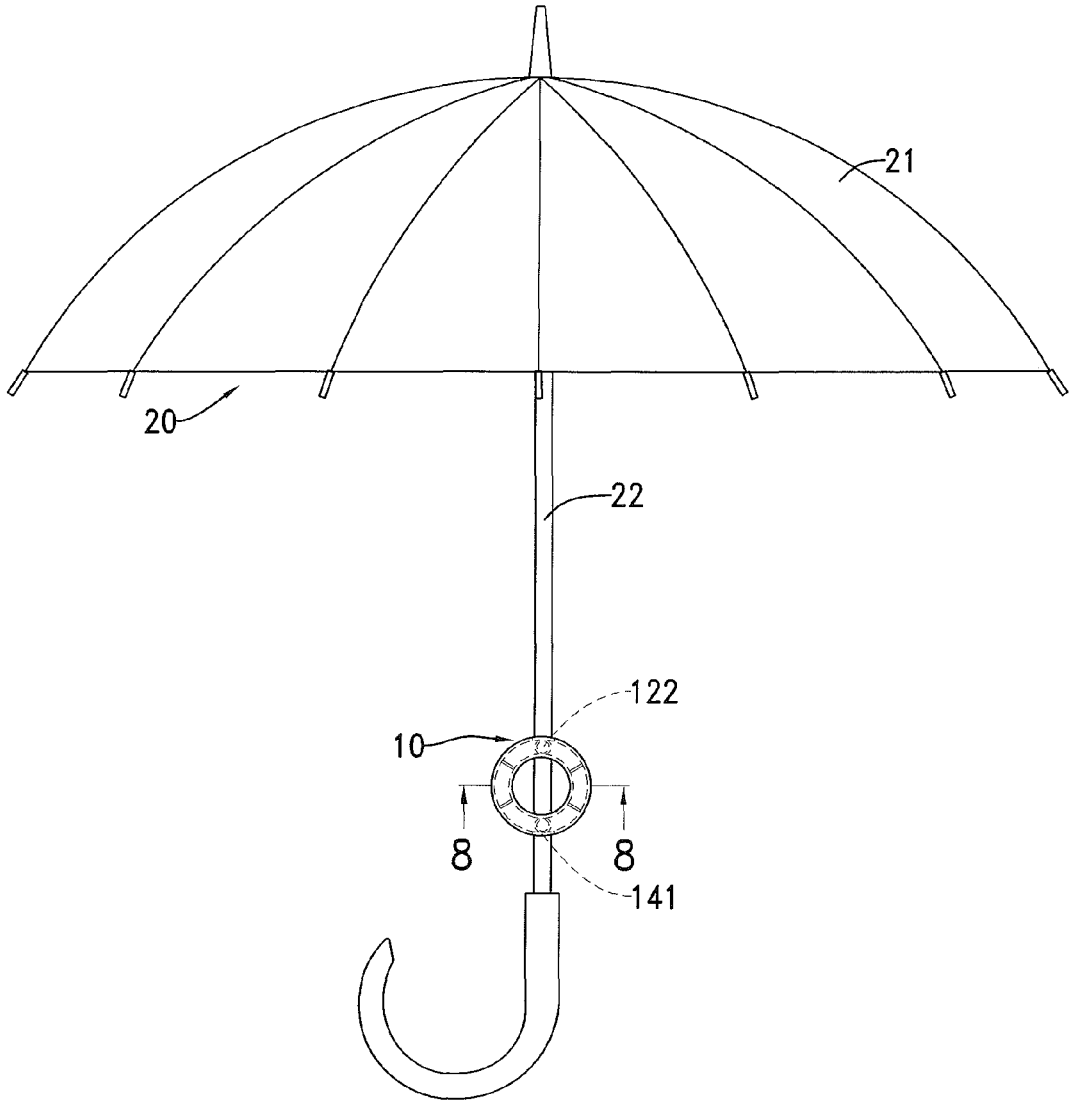
FIG. 7 is a schematic view of the magnetic ring and the umbrella in accordance with the present invention.
Figure 8:
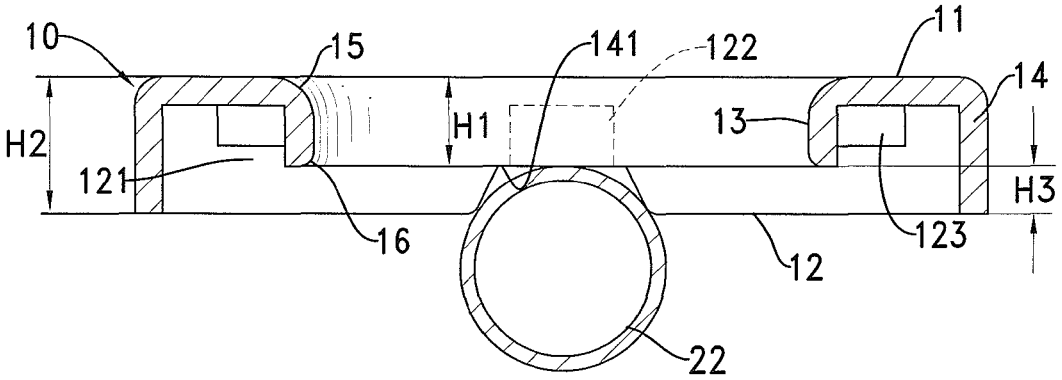
FIG. 8 is a cross-sectional side view of the magnetic ring and the umbrella in FIG. 7.

With reference to FIGS. 7 and 8, users can remove the magnetic ring 10 from the canopy 21 before unfolding the umbrella 20. Then users can attach the magnetic ring 10 on the umbrella stem 22 by magnetic attraction of the magnetic components 122, and the umbrella stem 22 abuts the notches 141, thereby avoiding losing the magnetic ring 10.

In summary, the magnetic ring 10 facilitates firm and durable folding and fastening of an umbrella 20. The magnetic ring 10 does not scratch or damage the surface of the canopy in the encircling-and-sliding process due to the smooth surface of the inner side part 13, the first chamfer 15, and the second chamfer 16. In addition, the magnetic ring 10 can be attracted to the umbrella stem 22 after the umbrella 20 is unfolded. The magnetic ring 10 can be used with high durability. The present invention provides enhanced convenience for umbrella users.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A magnetic ring, the magnetic ring being a hollow ring and comprising:

a top, a bottom opposite to the bottom, and an inner side part connecting along inner edges of the top and the bottom; and an outer side part connecting along outer edges of the top and the bottom;

wherein an annular groove is formed in the bottom and at least one magnetic component is mounted in the annular groove of the bottom; a first chamfer is formed between the top and the inner side part, and a second chamfer is formed between the bottom and the inner side part.

2. The magnetic ring as claimed in claim 1, wherein curvature of the first chamfer is larger than curvature of the second chamfer.

3. The magnetic ring as claimed in claim 2, wherein the inner side part is a smooth surface.

4. The magnetic ring as claimed in claim 3, wherein two magnetic components are mounted in the annular groove of the bottom; the two magnetic components are embedded at two opposite positions in the annular groove.

5. The magnetic ring as claimed in claim 4, wherein multiple ribs are formed in the annular groove between the two magnetic components.

6. The magnetic ring as claimed in claim 2, wherein two magnetic components are mounted in the annular groove of the bottom; the two magnetic components are embedded at two opposite positions in the annular groove.

7. The magnetic ring as claimed in claim 6, wherein multiple ribs are formed in the annular groove between the two magnetic components.

8. The magnetic ring as claimed in claim 1, wherein the inner side part is a smooth surface.

9. The magnetic ring as claimed in claim 8, wherein two magnetic components are mounted in the annular groove of the bottom; the two magnetic components are embedded at two opposite positions in the annular groove.

10. The magnetic ring as claimed in claim 9, wherein multiple ribs are formed in the annular groove between the two magnetic components.

11. The magnetic ring as claimed in claim 1, wherein two magnetic components are mounted in the annular groove of the bottom; the two magnetic components are embedded at two opposite positions in the annular groove.

12. The magnetic ring as claimed in claim 11, wherein multiple ribs are formed in the annular groove between the two magnetic components.

13. The magnetic ring as claimed in claim 11, wherein the height of the inner side part is less than the height of the outer side part; two notches are formed oppositely from the bottom toward the top, near the outer edge of the bottom, and on the outer side part, and the notches are corresponding in position to the magnetic components; the height of each notch is equal to the height difference between the inner side part and the outer side part.

* * * * *